United States Patent [19]

Liautaud

[11] 4,173,761

[45] Nov. 6, 1979

[54] MOBILE ANTENNA MOUNTING ASSEMBLY

[75] Inventor: James P. Liautaud, Cary, Ill.

[73] Assignee: American Antenna Corporation, Elgin, Ill.

[21] Appl. No.: 860,237

[22] Filed: Dec. 13, 1977

[51] Int. Cl.[2] ..... H01Q 1/42

[52] U.S. Cl. ..... 343/715; 343/900; 343/888

[58] Field of Search ..... 343/711–715, 343/749, 750, 745, 850, 900, 901, 880, 882, 906, 888

[56] References Cited

U.S. PATENT DOCUMENTS 4,047,779 9/1977 Klancnik ..... 343/715

*Primary Examiner*—David K. Moore

*Attorney, Agent, or Firm*—Lockwood, Dewey, Alex & Cummings

[57] ABSTRACT

An angularly adjustable antenna mounting assembly for mounting a mobile antenna to the exterior surface of a motor vehicle includes a semi-hemispherical mounting shell. The antenna base is secured to the exterior surface of the shell by a pin member which extends through the shell and is retained therein by a retaining plate biased against the interior surface of the shell. The antenna is connected to the other end of the pin member by a quick-release bayonet connection which also serves to establish electrical connection to the antenna. The mounting angle of the antenna is adjusted by adjusting the location of the bridging plate within the shell.

19 Claims, 10 Drawing Figures

FIG. 6
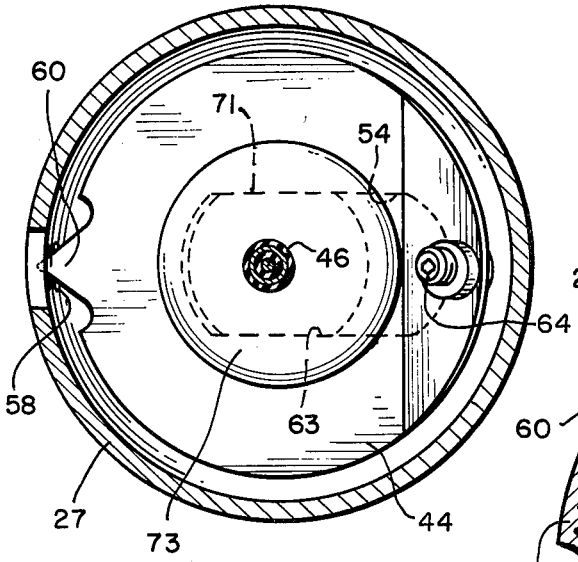
FIG. 8
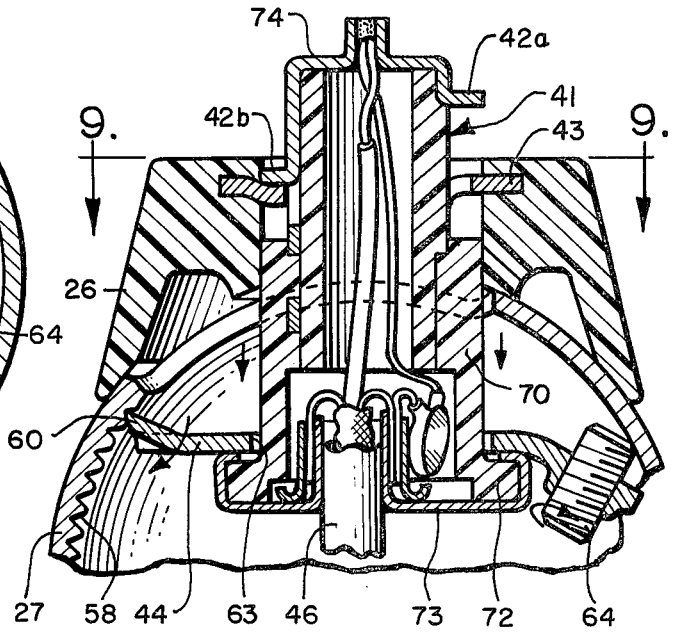
FIG. 9
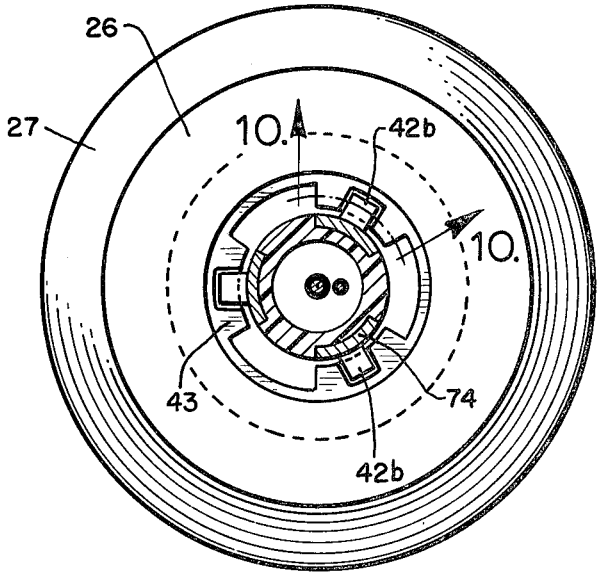
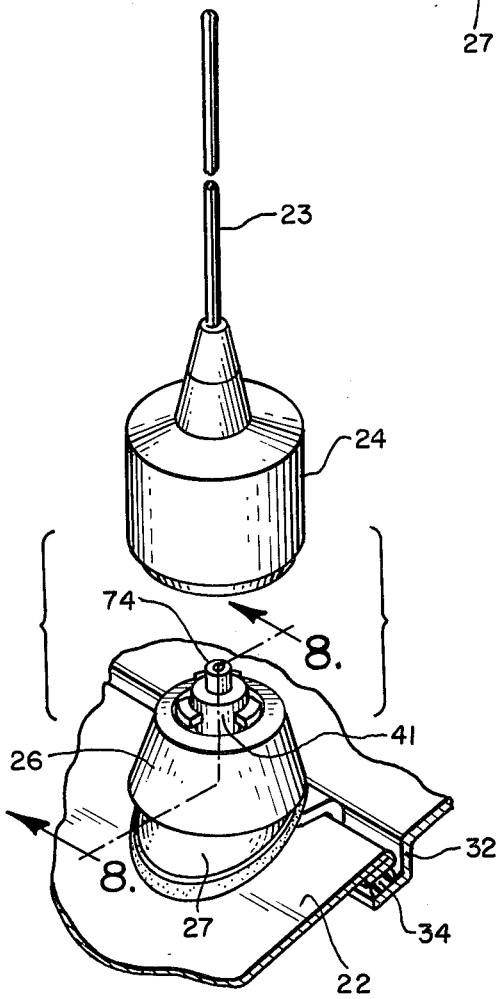
FIG. 7
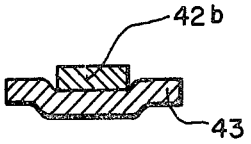
FIG. 10

MOBILE ANTENNA MOUNTING ASSEMBLY

BACKGROUND OF THE INVENTION

The present invention relates generally to mobile antennas, and more particularly to a mounting assembly for a mobile antenna which allows the angle of the antenna to be adjusted with respect to an underlying mounting surface.

In recent years the increased use of personal mobile communications equipment, particularly equipment intended for use on the citizens band, has created the need for high-frequency mobile antennas which can be easily mounted to external vehicle surfaces, such as trunk lids and fenders. Unfortunately, such surfaces are often either not flat or not horizontal, making it difficult to obtain the vertical orientation of the mobile antenna required for optimum transmitting and receiving efficiency.

Prior art mobile antennas intended for mounting on horizontal mounting surfaces utilized one or more pivotal connections between the antenna base and the supporting surface. This resulted in an undesirably large and complex structure which was not aesthetically pleasing. Furthermore, such assemblies were not readily removable from the antenna and did not allow the antenna to be directly mounted in applications where no angular adjustment was necessary.

It is therefore a general object of the present invention to provide a new and improved antenna mounting assembly for a mobile antenna which allows the antenna to be vertically positioned regardless of the slope of the body panel on which the mounting assembly is affixed.

It is another object of the present invention to provide a new and improved antenna mounting assembly which can be readily removed from an antenna to allow the antenna to be mounted directly to a supporting surface.

SUMMARY OF THE INVENTION

The invention is directed to an antenna mounting assembly for affixing a mobile antenna to an exterior mounting surface. The antenna mounting assembly includes a semi-hemispherical shell including retaining means for fixedly attaching the shell to the mounting surface, and a longitudinally extending slot-shaped aperture extending therethrough. A skirt member positioned on the outer surface of the shell is fixedly attached to the antenna. A mounting pin engaged to the antenna at one end is drawn through the shell aperture by a locking plate bridging the interior surface of the shell to draw the skirt member against the shell surface to maintain the antenna in a desired angular position with respect to the mounting surface.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

FIG. 6 is a perspective view of the mobile antenna showing the antenna removed from the antenna mounting assembly.

FIG. 7 is an enlarged sectional view of the antenna mounting assembly taken along line 7—7 of FIG. 6.

FIG. 8 is a perspective view of the mobile antenna showing the antenna mounted directly on the body panel.

FIG. 9 is an enlarged cross-sectional view of the antenna mounting assembly taken along line 9—9 of FIG. 8.

DETAILED DESCRIPTION OF THE PREFERRED EMBODIMENT

Figure 1:
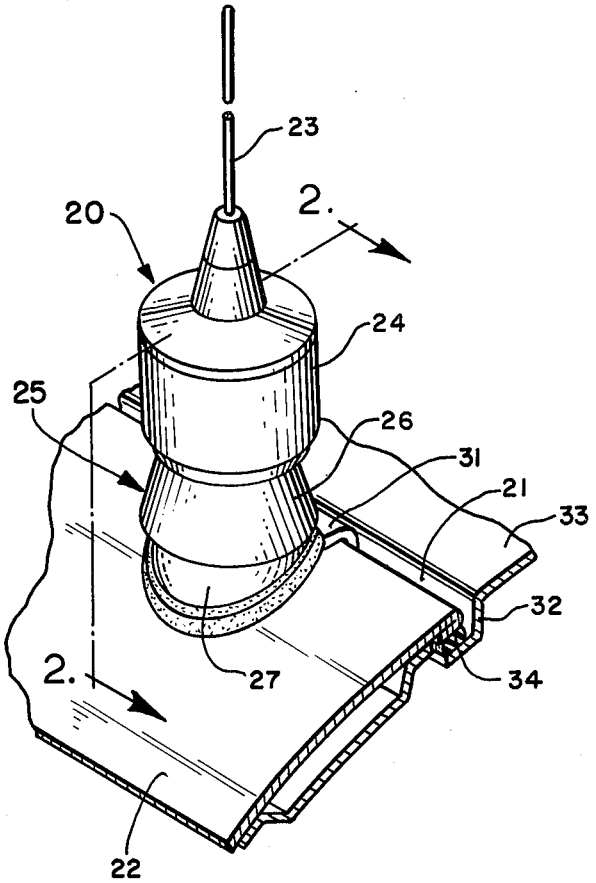
FIG. 1 is a perspective view of a mobile antenna wherein the antenna mounting assembly of the present invention is utilized to mount the antenna to a non-horizontal body panel.

Referring to the Figures, and particularly to FIG. 1, a mobile antenna 20 constructed in accordance with the invention is shown secured to the lip or edge 21 of a generally flat support surface in the form of a body panel 22, in this case the trunk lid of an automobile. The antenna includes a vertical radiating portion 23 and a base portion 24 from which the radiating portion extends. Reference is made to the copending applications of James P. Liautaud entitled "Mobile Antenna", Ser. No. 860,236; "Mobile Antenna With Adjustable Radiating Element", Ser. No. 860,245; "Mobile Antenna With Quick Release Mounting", Ser. No. 860,247; and "Antenna Mounting Adaptor" Ser. No. 860,234, filed concurrently herewith, for a detailed description of a preferred construction of the antenna and mounting arrangements therefore.

The antenna base is releasably mounted on an antenna mounting assembly 25 which, in accordance with the invention, is angularly adjustable to allow tilting of the antenna to a desired angular position with respect to the underlying support surface 25. The antenna mounting assembly includes a skirt member 26 which is mounted for adjustable movement on the outside surface of a semi-hemispherical shell 27. The flat bottom surface of the shell rests in a protective grommet or pad 30 which contacts the body panel 22. A C-shaped clip 31 extending from one side of the shell 27 engages the lip of the body panel to secure the shell member in position. In the trunk lid mounting application shown the clip is compressed between panel 22, the channel 32 of an adjacent non-movable panel 33 to which panel 22 is mounted, and a weather seal 34.

Figure 2:
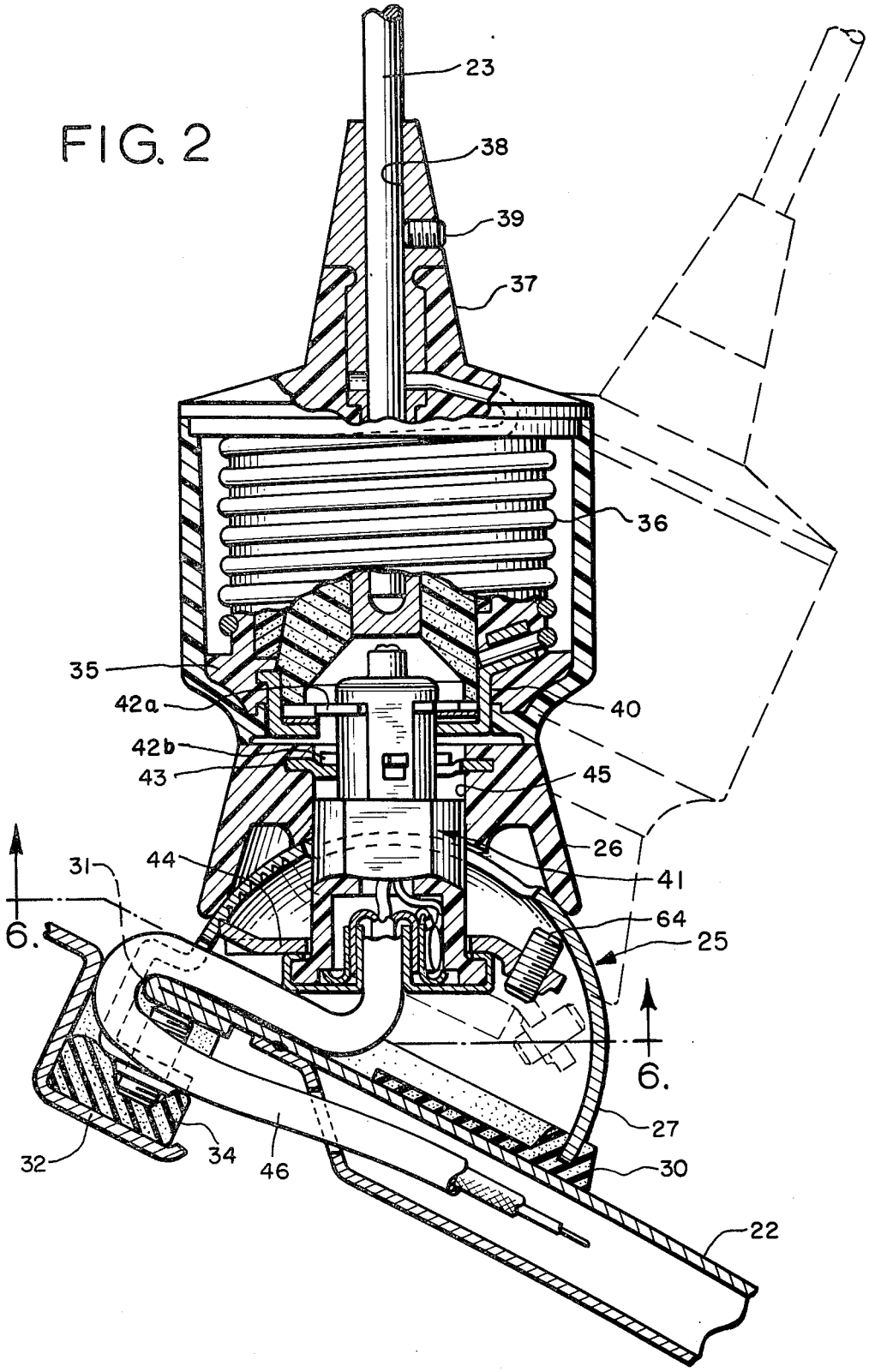
FIG. 2 is an enlarged side elevational view partially in section of the antenna and antenna mounting assembly taken along line 2—2 of FIG. 1.

Referring to FIG. 2, the antenna base 24 includes a cylindrical core assembly 35 on which an antenna loading coil 36 is wound. The loading coil is electrically connected at its upper end to an end fitting 37, which includes an axially extending bore 38 for receiving radiating element 23. A set screw 39 retains the radiating element in position. The lower end of the loading coil is electrically connected to an annular electrically conductive contact plate 40 which forms in conjunction with other elements of the base a socket in which a mounting pin 41 is received to provide a quick-release mounting connection for the antenna.

Mounting pin 41, which is preferably cylindrical in form, is removably attached at one end to base 24 and skirt 27 by respective sets of radially projecting mounting ears 42*a* and 42*b* contained within respective axially spaced planes perpendicular to the axis of the pin. Ears 42*a* engage complimentary detent surfaces on contact plate 40, and ears 42*b* engage detent surfaces on a skirt locking plate 43 embedded in skirt member 26 to form quick-release bayonet-type connections to these elements. The other end of mounting pin 41 is retained within the interior of shell 27 by an adjustable locking plate 44, which causes pin 4, and hence skirt 26, to be drawn into tight friction contact with the exterior surface of shell 27. At the same time, as developed in the afore-identified copending application, electrical contact is maintained between antenna 24 and a connecting coaxial cable 46.

As shown in FIG. 2, locking plate 44 may occupy a plurality of different positions within shell 27, each providing a different mounting angle for the antenna with respect to the underlying support surface 22. By changing the position of plate 44 inside shell 27 as shown the mounting angle of the antenna is changed in an arcuate manner, thus enabling the antenna to be positioned vertically even when the body panel 22 to which the antenna is affixed is inclined from the horizontal.

Figure 3:
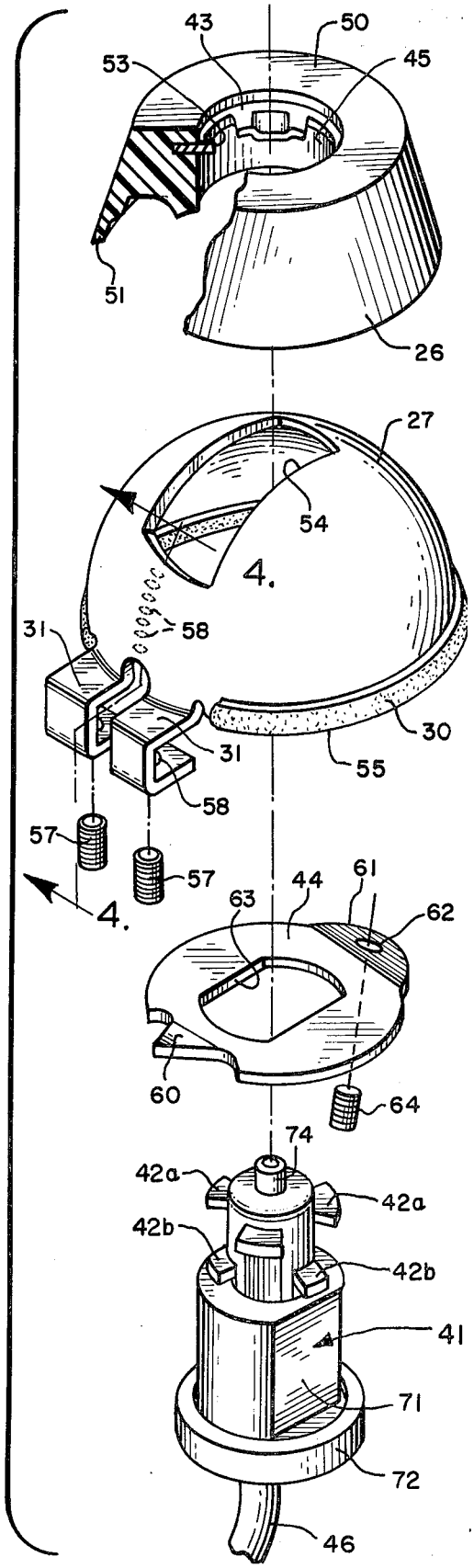
FIG. 3 is an enlarged exploded perspective view of the principal components of the antenna mounting assembly.

The inter-relationship between skirt 26, shell 27, retaining plate 44 and mounting pin 41 is shown in greater detail in FIG. 3. Skirt 26, which has the general shape of a truncated hollow cone, includes a flat top surface 50 and an annular bottom rim 51 which is adapted to engage the outer surface of shell 27. The quick-connect retaining ring 43 is embedded within the skirt so as to extend inwardly of aperture 45 in an aligned, generally perpendicular relation to the axis thereof. Retaining ring 43 includes a plurality of detents 52 and keyways 53 equi-spaced around the circumference thereof to engage the tabs 42*b* of mounting pin 41.

The semi-hemispherical shell 27 and clip portion 31 thereof are preferably formed as a single element from drawn sheet metal. An aperture 54, which in this embodiment is an elongated slot, extends from a position adjacent the center of the shell downwardly toward retaining clip 31. Shell 27 includes a generally flat annular bottom rim 55 which is nested in the removable protective cover 30 when mounted on a motor vehicle body panel.

The C-shaped clip 31 is bifurcated by an elongated cable aperture 56 through which the cable 46 is routed while rounding the edge of the body panel. Clip 31 is fixedly retained on the edge of the body panel (FIG. 1) by a pair of set screws 57 which are received in threaded apertures 58 through the ends of the clip. As set screws 57 are tightened they engage the inner side of the body panel lip to secure the antenna mounting thereto. A plurality of notches 58 may be optionally provided on the interior surface of shell 27 along a line extending from the top of cable aperture 56 to the bottom edge of slot 54 to assist in positioning locking plate 44 within the shell.

Figure 4:
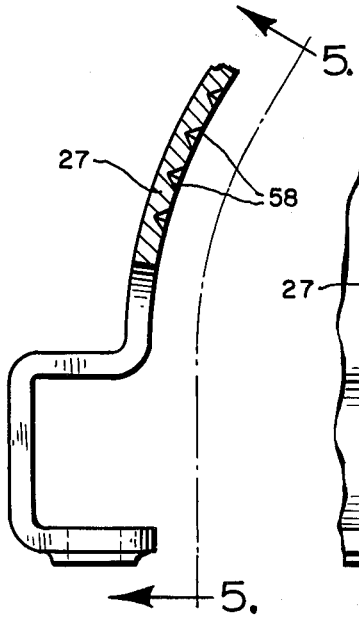
FIG. 4 is a cross-sectional view of the shell of the antenna mounting assembly taken along line 4—4 of FIG. 3.
Figure 5:
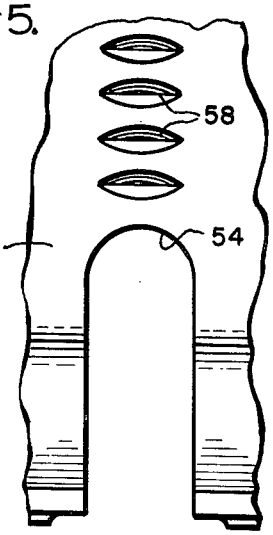
FIG. 5 is a side elevational view of a portion of the interior surface of the shell taken along line 5—5 of FIG. 4.

As shown in FIGS. 4 and 5, the optional notches 58 may each be elliptically shaped so as to matingly engage and retain a pointed end portion on locking plate 44. It will be appreciated that the shape and position of the notches may be varied around the interior of the shell depending upon the desired angular movement of the bayonet mounting, and upon the shape of the shell aperture 54, which may also be of different configurations than shown in the preferred embodiment.

Referring again to FIG. 3, the locking plate 44 may be generally circular in outline, and may include at one end a pointed pivot portion 60 and at its other end an adjustable stop portion 61. The stop portion may be bent downwardly at an acute angle from the main body of the locking plate and may include a threaded aperture 62. The pivot portion 60 may extend upwardly at an acute angle from the main body of the plate. An aperture 63 having opposed side detent portions is provided in the locking plate between the opposed tabular portions 60 and 61. When assembled aperture 63 receives the lower portion of mounting pin 41, and the pointed portion 61 of the locking plate is fitted against the interior of shell 27, within one of the optional indents 58 if provided, and a set screw 64 is threaded into the opposing tabular portion 61 so as to engage the inner surface of shell 27.

As shown in FIG. 2, as pivot portion 61 is moved from one location to another, set screw 64 slides along the inner wall of shell 27 and the angular orientation of mounting pin 41, and hence the antenna, changes. Once the desired orientation has been obtained, the set screw is tightened to draw skirt member 26 down against the surface of shell 25 and lock the antenna in position.

Referring to FIGS. 6 and 7, the bayonet mounting pin 41 includes, in this embodiment, an injection-molded generally cylindrical body portion 70 having a pair of flat opposed key surfaces 71 (FIG. 3) thereon for preventing rotation. Apertures 54 and 63 are dimensioned to receive body portion 70 therethrough, key surfaces 71 swing to prevent rotation of the pin with respect to shell 27 and locking plate 41. The bottom end of mounting pin 41 includes an enlarged flange portion 72 which engages locking plate 41 to prevent the pin member from sliding through aperture 63. A first electrically conductive end cap 73 fitted over flange portion 72 and connected to the shield of coaxial cable 46 establishes electrical contact between the shield and locking plate 41. Since plate 41 is electrically connected to shell 27, which in turn is electrically connected through its integral clip portion 31 to the underlying body panel 22, this serves to establish a grounding connection for the shield to the body, thereby providing a ground plane for the antenna. Electrical connection between the center conductor of coaxial cable 46 and the antenna loading coil is established by a second electrically conductive end cap 74, which is electrically connected to the center conductor and disposed at the other end of housing 70. End cap 74 includes locking tabs 42*a* and 42*b* formed as an integral part thereof. When pin 41 is connected to base 26, tabs 42*a* establish electrical contact with plate 40. Since plate 40 is connected to loading coil 40, the desired connection to the loading coil is automatically established.

As shown in FIG. 7, the antenna base 24 can be removed from mounting pin 41 by twisting base 24 to disengage tabs 42*a* from plate 43, leaving only the skirt member 26 and antenna mounting assembly 25 attached to plate 22. It should be noted that removal of the base member in this manner does not disturb the angular alignment of the antenna with respect to the support surface, and that electrical connections are automatically opened to the antenna. To reinstall the antenna, it is only necessary to twist-lock the base back on the mounting pin.

Where a flat horizontal surface is available for mounting the antenna, it is possible to mount the antenna without the use of shell member 27. This is shown in FIGS. 9 and 10, where the mounting pin 41 extends through an aperture 75 in plate 22. The antenna base 24 is engaged by the pin as before, and the pin is drawn downwardly to bring the rim of skirt 26 into contact with the exterior surface of body panel 22 by means of locking plate 44. In this case, the pivot and adjustable stop ends of locking plate 44 bear against the interior surface of the support plate.

While particular embodiments of the invention have been shown and described, it will be obvious to those skilled in the art that changes and modifications may be made therein without departing from the invention in its broader aspects. Therefore, the aim in the appended claims is to cover all such changes and modifications as fall within the true spirit and scope of the invention.

I claim:

1. A mounting assembly for affixing a mobile antenna to an exterior mounting surface comprising, in combination:

a semi-hemispherical mounting shell including retaining means for fixedly attaching the shell to the mounting surface, and having an elongated aperture extending therethrough;

a skirt member movably positioned on the spherical outer surface of said shell, said skirt being fixedly attachable to said antenna;

a mounting pin extending through said aperture and said skirt, said pin having connecting means at the end beyond said aperture for engaging said antenna, and further including projecting means for connecting said skirt to said pin, locking means at the other end of said pin for drawing said pin away from the inside surface of said shell whereby said skirt member is drawn against the outside surface of said shell to maintain the antenna in a desired angular position with respect to said mounting surface.

2. An antenna mounting assembly as defined in claim 1 wherein said locking means include a locking plate having ends bridging said aperture to engage the inside surface of said shell on either side of said aperture, and an aperture in said locking plate intermediate the ends thereof for receiving said mounting pin, and flange means at said other end of said pin for preventing said pin from being drawn through said aperture in said locking plate.

3. An antenna mounting assembly as defined in claim 2 wherein said locking plate includes an adjustable stop member mounted at one end of said locking plate and engaging said inner surface of said shell to adjust the spacing between said one end of said plate and said inside surface of said shell.

4. An antenna mounting assembly as defined in claim 3 wherein the other end of said plate member includes a detent surface for engaging the interior surface of said shell.

5. An antenna mounting assembly as defined in claim 4 wherein said interior surface of said shell includes a plurality of recesses for engaging said detent position.

6. An antenna mounting assembly as defined in claim 1 wherein said elongated aperture in said shell is a slot having a pair of substantially flat opposed sides, and said pin member includes a body portion having a pair of opposed flat surfaces thereon adapted for sliding engagement with respective ones of said flat surfaces to prevent rotation of said pin within said slot.

7. An antenna mounting assembly as defined in claim 6 wherein said aperture in said locking plate includes a pair of substantially flat opposed surfaces complimentarily spaced with respect to said pin surfaces to prevent rotation of said locking plate with respect to said pin.

8. An antenna mounting assembly as defined in claim 1 wherein said connecting means are releasable to enable said antenna to be removed from said pin.

9. An antenna mounting assembly as defined in claim 1 wherein said mounting pin includes means for establishing an electrical connection with the antenna therewith.

10. A mounting assembly as defined in claim 1 wherein said shell member and said locking means are electrically conductive and in an electrically conductive relationship, and said mounting pin includes an electrically non-conductive body portion, and means at said other end thereof for receiving a coaxial cable, and wherein said locking means establish an electrical grounding contact between the shield of said coaxial cable and said shell member.

11. A mounting assembly as defined in claim 1 wherein said shell and retaining means are formed from a single piece of metal.

12. A mounting assembly as defined in claim 2 wherein said shell member and said locking plate are electrically conductive, and said mounting pin includes an electrically non-conductive body portion extending through said aperture in said shell, and means at said other end thereof for receiving a coaxial cable, and wherein said flange means are electrically conductive and in electrical contact with the shield of said coaxial cable whereby said locking plate establishes a grounding electrical contact between said shield and said shell member.

13. A mounting assembly for adjustably securing a mobile antenna to a generally flat mounting surface comprising, in combination:

a hollow generally skirt-shaped base member;

a hollow dome-shaped shell member dimensioned to receive said base member in supporting relationship on the outer surface thereof, and including a generally flat bottom adapted to rest on said mounting surface, and an aperture extending through said dome at a portion of the top of said dome;

a mounting pin extending through said shell aperture and said base member, said pin including quick-release means at the end beyond said base member for engaging said antenna and further including projecting means for connecting said skirt to said pin;

a locking plate within said shell member including a central aperture therein for receiving said mounting pin, said locking plate being pivoted against the interior surface of said shell at one end and including adjustable stop means at its other end for adjustably spacing said other end from said interior surface; and said other end of said mounting pin including a cap portion preventing said pin from being withdrawn through said aperture of said plate whereby said antenna base is drawn against said shell as said stop means is tightened to space said plate away from said interior surface.

14. A mounting assembly as defined in claim 13 wherein said dome-shaped hollow shell member includes a clip extending from the bottom thereof for securing said assembly to the edge of a body panel.

15. A mounting assembly as defined in claim 13 including a plurality of recesses on the inside surface of said shell member for engaging said one end of said locking plate.

16. A mounting assembly as defined in claim 13 wherein the antenna includes a portion removable from the base member, and said quick-release means include means for engaging said removable portion and said base member.

17. An angularly adjustable antenna for mounting on a generally flat surface comprising, in combination:

a radiating antenna portion, an antenna base portion on which said radiating portion is removably secured;

an angularly adjustable antenna mounting assembly adapted to be fixed to the supporting surface, and having a releasable mounting with said antenna, said antenna mounting assembly including a semi-hemispherical shell including retaining means for affixing the shell to the surface and an aperture extending through the shell across the topmost portion thereof, a skirt adapted to be movably positioned on said shell, a connecting pin extending through said shell aperture and further including projecting means for releasably engaging said base portion and said skirt, and means for drawing said connector pin into said shell whereby said antenna is fixedly attached to said shell member.

18. A mounting assembly as defined in claim 17 wherein said shell and said drawing means are electrically conductive, and said mounting pin includes an electrically non-conductive body portion, and means at said end of said pin internal of the shell for receiving a coaxial cable, and wherein said drawing means establish an electrical grounding contact between the shield of said coaxial cable and said shell.

19. A mounting assembly as defined in claim 17 wherein said shell and retaining means are formed from a single piece of metal.

* * * * *